US010101689B2

(12) United States Patent
Iwasawa et al.

(10) Patent No.: US 10,101,689 B2
(45) Date of Patent: Oct. 16, 2018

(54) IMAGE FORMING APPARATUS

(71) Applicant: CANON KABUSHIKI KAISHA, Tokyo (JP)

(72) Inventors: Yusaku Iwasawa, Mishima (JP); Tomoaki Nakai, Numazu (JP); Yu Izaki, Suntou-gun (JP); Takateru Ohkubo, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/647,033

(22) Filed: Jul. 11, 2017

(65) Prior Publication Data

US 2018/0017900 A1 Jan. 18, 2018

(30) Foreign Application Priority Data

Jul. 15, 2016 (JP) ..... 2016-140775

(51) Int. Cl.
*G03G 15/16* (2006.01)

(52) U.S. Cl.
CPC ..... *G03G 15/161* (2013.01); *G03G 15/1665* (2013.01)

(58) Field of Classification Search
CPC ..... G03G 15/161; G03G 2221/001
See application file for complete search history.

(56) References Cited

U.S. PATENT DOCUMENTS

2004/0213598 A1* 10/2004 Mori ..... G03G 15/166 399/101
2016/0091832 A1* 3/2016 Omata ..... G03G 15/161 399/101

FOREIGN PATENT DOCUMENTS

JP 3267507 B2 3/2002
JP 2011-133581 A 7/2011

* cited by examiner

*Primary Examiner* — Gregory H Curran
(74) *Attorney, Agent, or Firm* — Canon U.S.A., Inc. IP Division

(57) ABSTRACT

An image forming apparatus charges toner on a transfer belt by using a first brush and collects the toner, in which a second brush is provided on the upstream side of the first brush, and the amount of inroad of the second brush into the transfer belt is larger than the amount of inroad of the first brush into the transfer belt.

19 Claims, 9 Drawing Sheets

IMAGE FORMING APPARATUS

BACKGROUND

Field of the Disclosure

The present disclosure generally relates to image forming and, more particularly, to an image forming apparatus such as a printer, copying machine, and facsimile machine employing an electrophotographic method or electrostatic recording method.

Description of the Related Art

Examples of conventional electrophotographic image forming apparatuses employing an electrophotographic method include an intermediate transfer type image forming apparatus in which a toner image formed on a photosensitive member as an image bearing member is primarily transferred onto an intermediate transfer member and then secondarily transferred onto a recording material such as paper. A direct-transfer-type image forming apparatus is also known, in which a toner image formed on a photosensitive member is directly transferred onto a recording material borne by a recording material bearing member.

As an example, an intermediate-transfer-type image forming apparatus will be further described. In an intermediate-transfer-type image forming apparatus, residual toner remaining on an intermediate transfer belt after secondary transfer is removed from the intermediate transfer belt by an intermediate transfer member cleaning unit and then collected. For example, Japanese Patent No. 3267507 discusses an electrostatic collection method. In the electrostatic collection method, residual toner on the intermediate transfer belt is charged to the polarity opposite to the normal charging polarity of toner by a charging unit, moved to a photosensitive member, and collected by a photosensitive member cleaning unit, as an intermediate transfer member cleaning unit.

Japanese Patent Application Laid-Open No. 2011-133581 discusses a method for charging residual toner on an intermediate transfer belt to the polarity opposite to the normal charging polarity of toner by using a conductive brush as a charging unit for charging residual toner. By using a conductive brush as a charging unit to rub residual toner, the residual toner can be charged while a toner layer is made uniform. Therefore, even when there is a large amount of residual toner, toner can be uniformly charged. The conductive brush can also temporarily collect toner charged to the normal charging polarity of toner contained in residual toner, thus improving the cleaning performance.

However, the image forming apparatus using a conductive brush as a charging unit has the following problem.

After secondary transfer, there is not only residual toner but also a small amount of paper dust, transferred from paper as a recording material at the secondary transfer portion, on the intermediate transfer belt. With the movement of the intermediate transfer belt, the small amount of paper dust is sent to the contact portion (also referred to as a "toner charging portion") between the conductive brush and the intermediate transfer belt on the downstream side of the secondary transfer portion. Part of paper dust sent to the toner charging portion is caught by the conductive brush and accumulated in the conductive brush. Although the amount of paper dust transferred onto the intermediate transfer belt depends on environmental conditions and paper type, the amount of such paper dust basically increases with increasing number of prints. In other words, when a large number of sheets are printed, a large amount of paper dust will be sent to the toner charging portion.

A small amount of paper dust accumulated in the conductive brush causes no problem. However, if the amount of accumulated paper dust increases and a paper dust accumulation substance (an enlarged lump of entwined paper dust) is formed between the conductive brush and the intermediate transfer belt, residual toner may not be suitably charged by the conductive brush. Part of residual toner not suitably charged cannot be collected onto the photosensitive member at a primary transfer portion, causing a cleaning failure of the intermediate transfer belt.

A conventional problem regarding the cleaning of the intermediate transfer belt has been described above. Since fogging toner (toner adhering to the non-image area) adheres to the recording material bearing member, the cleaning of the recording material bearing member is performed to remove this toner (residual toner). Therefore, a similar problem to the above one may also arise on the cleaning of the recording material bearing belt. Hereinbelow, the intermediate transfer belt and the recording material bearing belt are collectively referred to as a transfer belt.

SUMMARY

One or more aspects of the present disclosure are directed to an image forming apparatus including a brush for charging residual toner on a transfer belt and capable of preventing accumulation of paper dust in the brush.

Further features of the present disclosure will become apparent from the following description of exemplary embodiments with reference to the attached drawings.

DESCRIPTION OF THE EMBODIMENTS

An image forming apparatus according to one or more aspects of the present disclosure will be described in more detail below with reference to the accompanying drawings.

(1) Overall Configuration and Operation of Image Forming Apparatus

Figure 1:
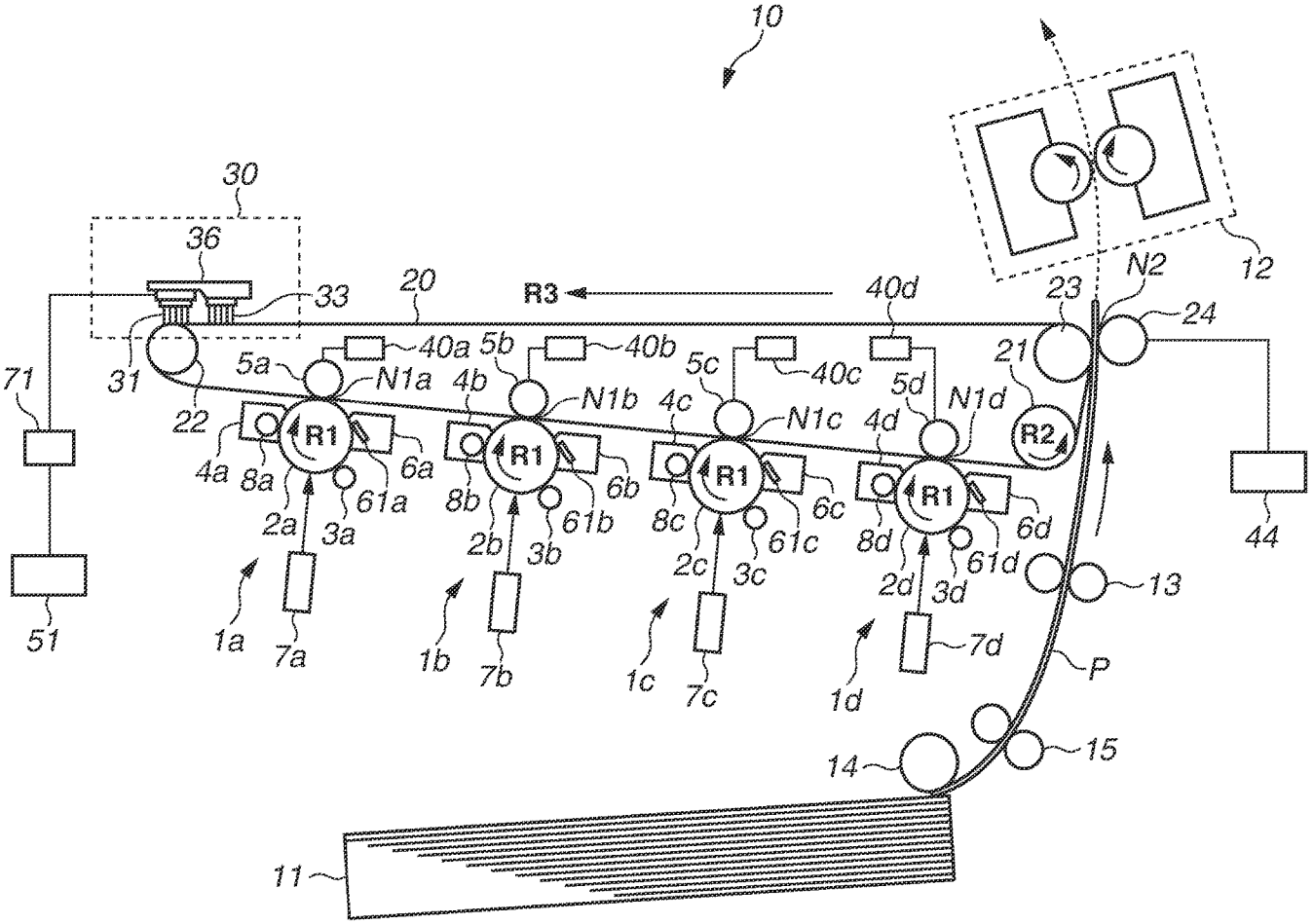
FIG. 1 is a sectional view schematically illustrating an image forming apparatus.

FIG. 1 is a sectional view schematically illustrating an image forming apparatus 10 according to a first exemplary embodiment. The image forming apparatus 10 according to the present exemplary embodiment is a full color in-line type printer employing the intermediate transfer method and capable of forming a full color image by the electrophotographic method. The image forming apparatus 10 according to the present exemplary embodiment includes a plurality of image forming units (stations): a first image forming unit 1*a* for forming a yellow (Y) image, a second image forming unit 1*b* for forming a magenta (M) image, a third image forming unit 1*c* for forming a cyan (C) image, and a fourth image forming unit 1*d* for forming a black (K) image. In the description of the image forming units 1*a*, 1*b*, 1*c*, and 1*d*, elements having an identical or corresponding function or configuration may be described in a comprehensive way. In such a case, trailing alphabetical characters (a, b, c, and d) indicating the corresponding colors will be omitted from the reference numerals. According to the present exemplary embodiment, the image forming unit 1 includes a photosensitive member 2, a photosensitive member charging roller 3, an exposure device 7, a development device 4, a primary transfer roller 5, and a photosensitive member cleaning device 6 (described below).

The drum-type photosensitive member (photoconductive drum) 2 as an image bearing member for bearing a toner image is rotatably driven at a predetermined circumferential speed (surface moving speed or process speed) in the direction (clockwise direction) indicated by the arrow R1 by a drive device (not illustrated). According to the present exemplary embodiment, the photosensitive member 2 is a negatively charged organic photoconductor (OPC) photosensitive member composed of an aluminum drum base and a photosensitive layer thereon. The surface of the rotating photosensitive member 2 is charged to a predetermined potential of a predetermined polarity (negative polarity in the present exemplary embodiment) by a photosensitive member charging roller 3 as a photosensitive member charging unit. In the charging process, the photosensitive member charging roller 3 is applied with a negative photosensitive member charging voltage (photosensitive member charging bias) from a photosensitive member charging power source (not illustrated). The charged surface of the photosensitive member 2 undergoes scanning exposure by the exposure device (laser scanner) 7 as an exposure unit according to image information, and an electrostatic latent image (electrostatic image) is formed on the photosensitive member 2.

The electrostatic latent image formed on the photosensitive member 2 is supplied with toner as a developer by the development device 4 as a developing unit. Then, the electrostatic latent image is developed (visualized) and a toner image is formed on the photosensitive member 2. The development device 4 includes a developing roller 8 as a developer bearing member for bearing toner and conveying the toner to the portion facing the photosensitive member 2. In the development process, the developing roller 8 is applied with a negative development voltage (development bias) from a development power source (not illustrated). According to the present exemplary embodiment, when the photosensitive member 2 is uniformly charged and then exposed to light, exposed portions where the absolute value of the potential is reduced are formed. Then, toner charged to the same charging polarity (negative polarity in the present exemplary embodiment) as the charging polarity of the photosensitive member 2 adheres to the exposed portions. More specifically, according to the present exemplary embodiment, the normal charging polarity of toner as the charging polarity of toner at the time of development is the negative polarity.

An intermediate transfer belt 20 formed of an endless belt is disposed to face photosensitive members 2*a*, 2*b*, 2*c*, and 2*d*. A toner image is primarily transferred from the image bearing member onto the intermediate transfer belt 20 at the primary transfer portion. The intermediate transfer belt 20 is an example of an intermediate transfer member that can circularly move to convey the toner image to the secondary transfer portion where the toner image is to be secondarily transferred onto a recording material. The intermediate transfer belt 20 is stretched on a plurality of stretching rollers including a driving roller 21, a cleaning counter roller 22, and a secondary transfer counter roller 23 with a predetermined tension. When the driving roller 21 is rotatably driven in the direction (counterclockwise direction) indicated by the arrow R2, the intermediate transfer belt 20 circularly moves (rotates) at approximately the same speed as the circumferential speed of the photosensitive member 2 in the direction (counterclockwise direction) indicated by the arrow R3. The primary transfer roller 5 as a primary transfer unit is disposed on the inner circumference surface of the intermediate transfer belt 20, corresponding to the photosensitive member 2. The primary transfer roller 5 is pressed toward the photosensitive member 2 via the intermediate transfer belt 20 to form the primary transfer portion (primary transfer nip) N1 where the photosensitive member 2 contacts the intermediate transfer belt 20. According to the present exemplary embodiment, the intermediate transfer belt 20 is made of a polyethylenenaphthalate (PEN) resin in the shape of an endless belt. The intermediate transfer belt 20 has a surface resistivity of $5.0\times10^{11}$ ohms per square (Ω/□) and a volume resistivity of $8.0\times10^{11}$ ohm-centimeters (Ω cm). The intermediate transfer belt 20 may be made of a resin such as polyvinylidene fluoride (PVDF), ethylene tetrafluoride-ethylene copolymer (ETFE), polyimide, polyethylene terephthalate (PET), and polycarbonate, in the shape of an endless belt. Alternatively, the intermediate transfer belt 20 may also be composed of a rubber base made of ethylene-propylene-diene (EPDM) rubber coated with urethane rubber containing a distributed fluoride resin such as polytetrafluoroethylene (PTFE), in the shape of an endless belt.

The toner image formed on the photosensitive member 2 as described above is electrostatically transferred (primarily transferred) onto the rotating intermediate transfer belt 20 at the primary transfer portion N1. In the primary transfer process, the primary transfer roller 5 is applied with a primary transfer voltage (primary transfer bias) as a direct-current (DC) voltage having the polarity opposite to the normal charging polarity of toner (having the positive polarity in the present exemplary embodiment) from a primary transfer power source (high-voltage power source circuit) 40. According to the present exemplary embodiment, the primary transfer power source 40 is capable of selectively applying a positive voltage and a negative voltage to the primary transfer roller 5. For example, when a full color image is formed, a yellow, magenta, cyan, and black toner images formed on the photosensitive members 2*a*, 2*b*, 2*c*, and 2*d*, respectively, are sequentially transferred onto the intermediate transfer belt 20 in a superimposed way.

A secondary transfer roller 24 as a secondary transfer unit is disposed at the position facing the secondary transfer counter roller 23 on the outer circumferential surface of the intermediate transfer belt 20. The secondary transfer roller 24 is pressed toward the secondary transfer counter roller 23 via the intermediate transfer belt 20 to form the secondary transfer portion (secondary transfer nip) N2 where the intermediate transfer belt 20 contacts the secondary transfer roller 24. At the secondary transfer portion N2, the toner image formed on the intermediate transfer belt 20 as described above is electrostatically transferred (secondarily transferred) onto a recording material (transfer material or recording medium) P such as paper pinched and conveyed by the intermediate transfer belt 20 and the secondary transfer roller 24. In the secondary transfer process, the secondary transfer roller 24 is applied with a secondary transfer voltage (secondary transfer bias) as a DC voltage having the polarity opposite to the normal charging polarity of toner (having the positive polarity in the present exemplary embodiment) from a secondary transfer power source (high-voltage power source circuit) 44. According to the present exemplary embodiment, the secondary transfer power source 44 is capable of selectively applying a positive voltage and a negative voltage to the secondary transfer roller 24. The recording material P stored in a recording material cassette 11 is conveyed to a registration roller pair 13 by feeding rollers 14 and a conveyance roller pair 15. After a skew has been corrected by the registration roller pair 13, the recording material P is supplied to the secondary transfer portion N2 in synchronization with the toner image on the intermediate transfer belt 20.

The recording material P with the toner image transferred thereon is conveyed to a fixing device 12 as a fixing unit. After the fixing device 12 heats and pressurizes the recording material P to fix (melt and fix) the toner image onto the surface thereof, the recording material P is discharged (output) out of the main body of the image forming apparatus 10.

Meanwhile, residual toner (primary transfer residual toner) remaining on the photosensitive member 2 on completion of the primary transfer process is removed and collected from the surface of the photosensitive member 2 by the photosensitive member cleaning device 6 as a photosensitive member cleaning unit. The photosensitive member cleaning device 6 includes a photosensitive member cleaning blade 61 as a cleaning member and a cleaning container 62. The photosensitive member cleaning blade 61 is a plate-shaped member formed of an elastic material such as urethane rubber, and is disposed in contact with the photosensitive member 2. The photosensitive member cleaning device 6 scratches residual toner from the surface of the rotating photosensitive member 2 by using the photosensitive member cleaning blade 61 and stores the toner in the cleaning container 62. Residual toner (secondary transfer residual toner) remaining on the intermediate transfer belt 20 on completion of the secondary transfer process is removed and collected from the surface of the intermediate transfer belt 20 by a belt cleaning device 30. The configuration and operation of the belt cleaning device 30 will described in detail below.

(2) Belt Cleaning Mechanism

Figure 2:
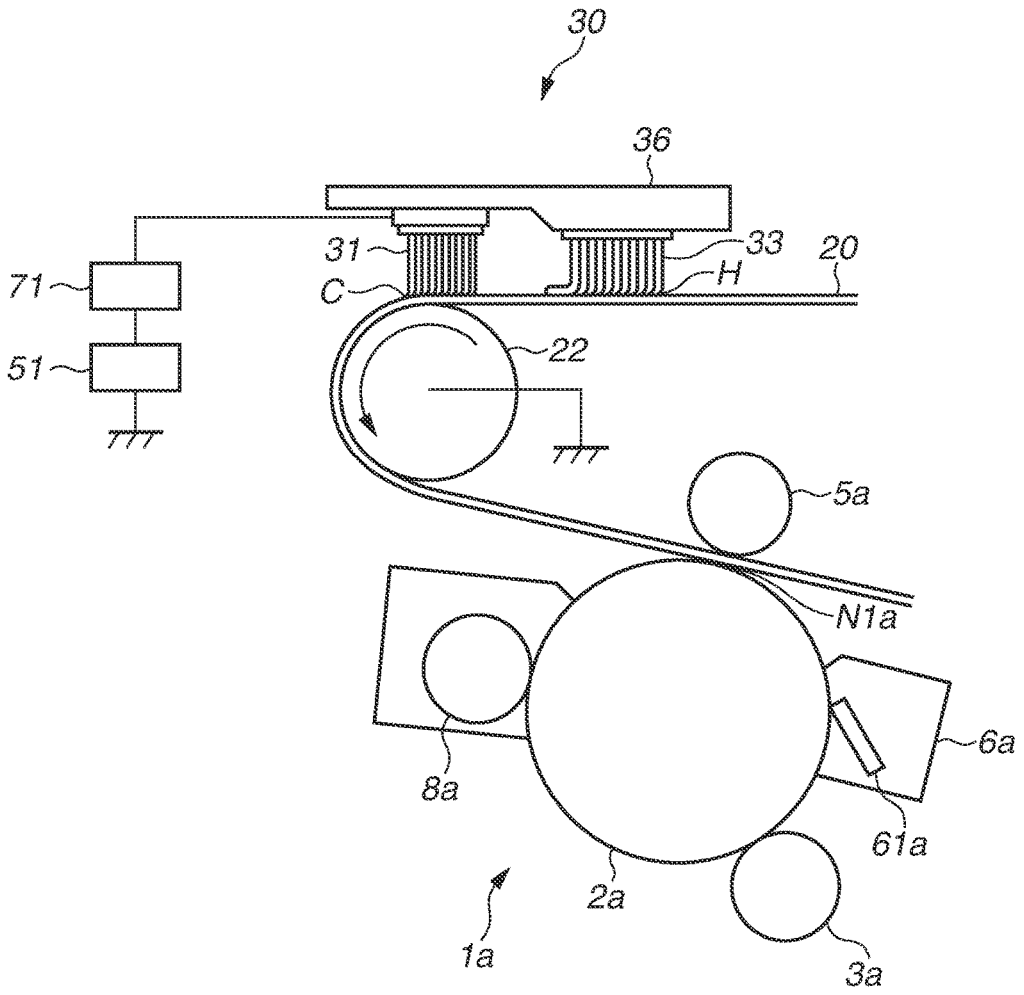
FIG. 2 is a sectional view schematically illustrating a belt cleaning device.

A belt cleaning mechanism according to the present exemplary embodiment will be described below. FIG. 2 is a sectional view schematically illustrating the belt cleaning device 30 according to the present exemplary embodiment.

According to the present exemplary embodiment, residual toner remaining on the intermediate transfer belt 20 on completion of secondary transfer is charged by the belt cleaning device 30 to the positive polarity opposite to the normal charging polarity of toner. Then, the residual toner is transferred onto the photosensitive member 2 at the primary transfer portion N1, and is collected by the photosensitive member cleaning device 6.

As illustrated in FIG. 2, the belt cleaning device 30 according to the present exemplary embodiment is provided with a conductive brush (first brush) 31 as a charging member for charging residual toner on the intermediate transfer belt 20. The conductive brush 31 is disposed so as to contact the intermediate transfer belt 20 on the downstream side of the secondary transfer portion N2 and on the upstream side of the primary transfer portion N1 (a primary transfer portion N1Y on the most upstream side) in the moving direction (rotational direction) of the intermediate transfer belt 20. In particular, according to the present exemplary embodiment, the conductive brush 31 is disposed at the position facing the cleaning counter roller 22 via the intermediate transfer belt 20. The contact portion between the conductive brush 31 and the intermediate transfer belt 20 is a toner charging portion C where residual toner on the intermediate transfer belt 20 is charged. The cleaning counter roller 22 is electrically grounded (connected to ground). The conductive brush 31, supported by a supporting member 36 and disposed at a fixed position relative to the intermediate transfer belt 20, rubs the surface of the intermediate transfer belt 20 with the movement of the intermediate transfer belt 20.

According to the present exemplary embodiment, the material of the brush fibers (pile) of the conductive brush 31 is nylon provided with electroconductivity. The brush fibers have a fineness of 7 decitex, a pile length of 5 mm, and a density of 70 KF/inch$^2$. According to the present exemplary embodiment, the length of the conductive brush 31 in the longitudinal direction (direction approximately perpendicular to the moving direction of the intermediate transfer belt 20) is equal to or larger than the length of the image forming region (a region where a toner image can be formed) in the same direction on the intermediate transfer belt 20. According to the present exemplary embodiment, the width of the conductive brush 31 in the lateral direction (moving direction of the intermediate transfer belt 20) is 5 mm. The conductive brush 31 has an electrical resistance of $1.0\times10^6$ ohms (Ω) when applied with 500 V in a state where the conductive brush 31 is pressed onto an aluminum cylinder with a force of 9.8 N and rotated at a rotational speed of 50 mm/second.

As illustrated in FIG. 1, the conductive brush 31 is electrically connected with a toner charging power source (high-voltage power source circuit) 51 via a current detection circuit 71 as a current detection unit. The toner charging power source 51 as a first power source can selectively apply a positive voltage and a negative voltage to the conductive brush 31. In the cleaning operation, the conductive brush 31 is applied with a cleaning voltage (cleaning bias) which is a positive DC voltage from the toner charging power source 51. The output value of the DC voltage of the toner charging power source 51 during the cleaning operation is controlled based on the current value detected by the current detection circuit 71, and is subjected to constant current control so that the current value becomes a preset target current value. The target current value is selected so as to neither excessively charge residual toner nor produce a cleaning failure of the intermediate transfer belt 20 due to insufficient charging. According to the present exemplary embodiment, the target current value is set to 20 μA.

According to the present exemplary embodiment, the belt cleaning device 30 includes the conductive brush 31, the supporting member 36, the current detection circuit 71, the toner charging power source 51, and a paper dust collection brush 33 (described below). The paper dust collection brush 33 will be described in detail below.

Before the secondary transfer process, toner on the intermediate transfer belt 20 is charged to the negative polarity which is the same as the polarity of the electrified charges on the surface of the photosensitive member 2, with small variations in the charge distribution. After the secondary transfer process, residual toner on the intermediate transfer belt 20 has a broad charge distribution. In addition, the peak of the charge distribution is deviated toward the side of the positive polarity opposite to the normal charging polarity of toner. Therefore, the residual toner contains negatively charged toner, toner hardly charged, and positively charged toner.

In the cleaning operation, when the conductive brush 31 is applied with the positive cleaning voltage, a positive electric field is formed from the conductive brush 31 toward the intermediate transfer belt 20. Then, negatively charged toner out of residual toner conveyed to the toner charging portion C with the movement of the intermediate transfer belt 20 is electrostatically collected by the conductive brush 31. In addition, residual toner is positively charged by the electric discharge between the conductive brush 31 and the residual toner. The residual toner positively charged by the conductive brush 31 is conveyed to a primary transfer portion N1*a* of the first image forming unit 1*a* with the movement of the intermediate transfer belt 20. Then, the residual toner is transferred from the intermediate transfer belt 20 to the photosensitive member 2*a* of the first image forming unit 1*a* by the action of the positive primary transfer voltage applied to a primary transfer roller 5*a* of the first image forming unit 1*a*. The residual toner is removed and collected from the surface of the photosensitive member 2*a* of the first image forming unit 1*a* by a photosensitive member cleaning device 6*a* of the first image forming unit 1*a*. When residual toner is temporarily collected and approximately uniformly charged to the positive polarity by the conductive brush 31, and then collected by the photosensitive member 2*a* in this way, residual toner can be removed from the surface of the intermediate transfer belt 20.

Residual toner positively charged by the conductive brush 31 can be transferred from the intermediate transfer belt 20 to the photosensitive member 2*a* at the same time as when the toner image is primarily transferred from the photosensitive member 2*a* onto the intermediate transfer belt 20.

To prevent the charging performance of the conductive brush 31 from being degraded by the accumulation of toner adhering to the conductive brush 31 when repetitively performing the cleaning operation, the following discharge operation is performed when an image is not being formed. More specifically, most of toner accumulated in the conductive brush 31 during the cleaning operation is negatively charged. Therefore, during the discharge operation, the conductive brush 31 is applied with a discharge voltage (discharge bias) as a negative DC voltage. Thus, toner accumulated in the conductive brush 31 is electrostatically discharged onto the intermediate transfer belt 20. During the discharge operation, a small amount of positively charged toner adhering to the conductive brush 31 may be also discharged by alternately applying a negative voltage and a positive voltage to the conductive brush 31. By suitably performing this discharge operation, for example, periodically performing the discharge operation, removing toner accumulated in the conductive brush 31 can be removed and the favorable cleaning performance can be maintained.

Toner discharged from the conductive brush 31 onto the intermediate transfer belt 20 during the discharge operation is transferred onto the photosensitive member 2 of at least one of the first image forming unit 1*a* to the fourth image forming unit 1*d* and then collected by the photosensitive member cleaning device 6. At this timing, the primary transfer roller 5 of at least one of the image forming units 1 is applied with a negative voltage (the polarity same as the polarity of the discharged negatively charged toner) from the primary transfer power source 40. When positively charged toner is discharged as described above, the primary transfer roller 5 of at least one of other image forming units 1 can be applied with a positive voltage from the primary transfer power source 40. The discharge operation can be performed when an image is not being formed, i.e., at the time of post-rotation which is an arrangement operation (standby operation) on completion of a print operation and at the print interval which is an interval between printing an image and printing a next image in a print operation for outputting a plurality of images.

(3) Paper Dust Collection Mechanism

A paper dust collection mechanism according to the present exemplary embodiment will be described below.

As illustrated in FIG. 2, the belt cleaning device 30 according to the present exemplary embodiment includes the paper dust collection brush (second brush) 33 as a paper dust collection member for collecting paper dust on the intermediate transfer belt 20. The paper dust collection brush 33 is disposed, in contact with the intermediate transfer belt 20, on the downstream side of the secondary transfer portion N2 and on the upstream side of the toner charging portion C in the moving direction (rotational direction) of the intermediate transfer belt 20. The contact portion between the paper dust collection brush 33 and the intermediate transfer belt 20 is a paper dust collection portion H where paper dust on the intermediate transfer belt 20 is collected. The paper dust collection brush 33, supported by the supporting member 36 and disposed at a fixed position relative to the intermediate transfer belt 20, rubs the surface of the intermediate transfer belt 20 with the movement of the intermediate transfer belt 20.

The paper dust collection brush 33 collects paper dust transferred from paper frequently used as the recording material P onto the intermediate transfer belt 20 at the secondary transfer portion N2. The paper dust collection brush 33 reduces the amount of paper dust moving to the toner charging portion C on the downstream side of the paper dust collection portion H in the moving direction of the intermediate transfer belt 20. This prevents accumulation of paper dust in the conductive brush 31. More specifically, during a print operation, part of paper dust adhering to paper transfers onto the intermediate transfer belt 20 at the secondary transfer portion N2. When paper dust transferred onto the intermediate transfer belt 20 reaches the paper dust collection portion H with the movement of the intermediate transfer belt 20, the paper dust is collected by the paper dust collection brush 33.

If the paper dust collection brush 33 is not provided, paper dust transferred onto the intermediate transfer belt 20 directly reaches the toner charging portion C. Then, paper dust blocked by the conductive brush 31 is accumulated in the conductive brush 31. There arises no problem if a small amount of paper dust is accumulated. However, with increasing number of prints, the amount of paper dust sent to the toner charging portion C increases and a lump of entwined paper dust enlarges at the toner charging portion C. As a result, a paper dust accumulation substance may be formed at the toner charging portion C. Paper dust is generally made of cellulose-based pulp fibers exfoliated from paper as the recording material P, and may contain a filler exfoliated from paper. A paper dust accumulation substance formed between the conductive brush 31 and the intermediate transfer belt 20 may disturb the electric discharge from the conductive brush 31 to residual toner, possibly preventing toner from being suitably charged. Residual toner that has not been suitably charged cannot be collected by the photosensitive member 2 at the primary transfer portion N1, resulting in a cleaning failure of the intermediate transfer belt 20.

In the paper dust collection brush 33 according to the present exemplary embodiment, an acrylic spun yarn is woven into a foundation cloth. As the material of brush fibers (weaving yarn) of the paper dust collection brush 33, not only acrylic fibers but also polyester and nylon fibers can be used. The material of brush fibers (weaving yarn) of the paper dust collection brush 33 may contain an electric conduction material such as carbon to be provided with electroconductivity. Crimped weaving yarn more easily catches paper dust and provides higher paper dust collection performance than straight weaving yarn. It is desirable to determine the density of the paper dust collection brush 33 in consideration of the balance between the permeability of toner and the paper dust collection performance. More specifically, if the density of the paper dust collection brush 33 is too high, the permeability of toner is degraded possibly causing a stack of toner at the paper dust collection portion H. On the contrary, if the density of the paper dust collection brush 33 is too low, the paper dust collection performance is degraded possibly causing an accumulation of paper dust in the conductive brush 31. Therefore, it is desirable to select the density of the paper dust collection brush 33 so as to ensure sufficient paper dust collection performance while maintaining favorable toner permeability. According to the present exemplary embodiment, the density of the paper dust collection brush 33 was set to 300 bundles/inch$^2$. According to the present exemplary embodiment, the count number of the paper dust collection brush 33 was set to 2/32 (by twisting two different threads each of which has a weight of 1 kg for a length of 32 km). According to the present exemplary embodiment, the length of the paper dust collection brush 33 in the longitudinal direction (direction approximately perpendicular to the moving direction of the intermediate transfer belt 20) is equal to or larger than the length of the image forming region on the intermediate transfer belt 20 in the same direction. According to the present exemplary embodiment, the width of the paper dust collection brush 33 in the lateral direction (moving direction of the intermediate transfer belt 20) is 20 mm. According to the present exemplary embodiment, the length of the bristles of the paper dust collection brush 33 is 6.5 mm. According to the present exemplary embodiment, the paper dust collection brush 33 is electrically grounded.

Figure 3A:
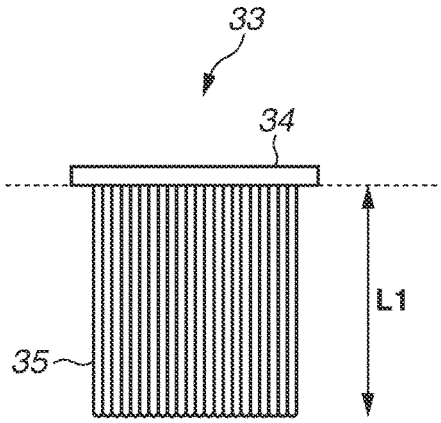
FIGS. 3A and 3B are schematic views illustrating the inroad amount of a paper dust collection brush.
Figure 3B:
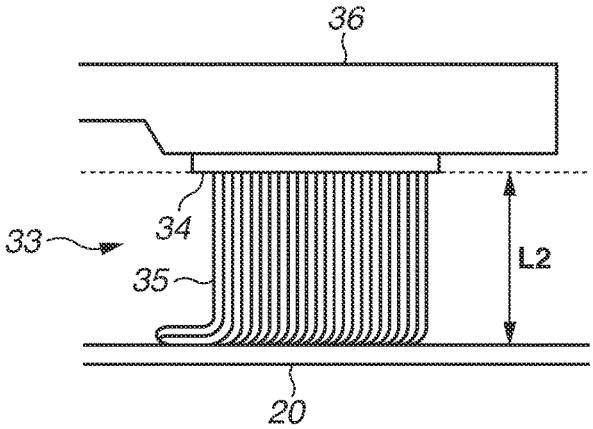

The amount of inroad of the paper dust collection brush 33 into the intermediate transfer belt 20 (also simply referred to as "the inroad amount of the paper dust collection brush 33") will be described below with reference to FIGS. 3A and 3B. FIG. 3A is a schematic view illustrating the paper dust collection brush 33 in a single state. FIG. 3B is a schematic view illustrating a state where the paper dust collection brush 33 is brought into contact with the intermediate transfer belt 20 (a state where the paper dust collection brush 33 is built in the image forming apparatus 10).

As illustrated in FIG. 3A, a distance L1 from a foundation cloth 34 to the tip of an acrylic spun yarn 35 (in the direction in which the paper dust collection brush 33 presses the intermediate transfer belt 20) in a single state of the paper dust collection brush 33 is referred to as a bristle length. In a single state of the paper dust collection brush 33, a force for bending the acrylic spun yarn of the paper dust collection brush 33 is not applied from the outside. The bristle length L1 according to the present exemplary embodiment is 6.5 mm. As illustrated in FIG. 3B, the paper dust collection brush 33 according to the present exemplary embodiment is disposed so that the foundation cloth 34 is fixed to the supporting member 36 by using a fastening means such as a two-sided adhesive tape and the bristle tip of the acrylic spun yarn 35 makes inroad into the intermediate transfer belt 20. The clearance between the supporting member 36 and the intermediate transfer belt 20 is fixed. When a distance L2 indicates the distance from the foundation cloth 34 to the intermediate transfer belt 20 (in the direction in which the paper dust collection brush 33 presses the intermediate transfer belt 20) in a state where the paper dust collection brush 33 is disposed on the supporting member 36, the inroad amount of the paper dust collection brush 33 is represented by L1-L2.

According to the consideration by the inventors, it turned out that the inroad amount of the paper dust collection brush 33 largely affected the paper dust collection performance of the paper dust collection brush 33. More specifically, the increase in the inroad amount of the paper dust collection brush 33 improves the paper dust collection performance of the paper dust collection brush 33. The increase in the inroad amount of the paper dust collection brush 33 increases the contact area between the paper dust collection brush 33 and the intermediate transfer belt 20 because the bristle tip of the paper dust collection brush 33 bends causing the bristle side portion to contact the intermediate transfer belt 20 (see FIG. 3B). The increase in the contact area between the paper dust collection brush 33 and the intermediate transfer belt 20 increases the effect that the paper dust collection brush 33 strips off and catches paper dust on the intermediate transfer belt 20, thus improving the paper dust collection performance. To ensure sufficient paper dust collection performance, it is desirable to provide a sufficient inroad amount of the paper dust collection brush 33. According to the present exemplary embodiment, the inroad amount of the paper dust collection brush 33 was set to 2.5 mm. More specifically, according to the present exemplary embodiment, the supporting member 36 is disposed so that the distance L2 becomes 4 mm, and the paper dust collection brush 33 is disposed on the supporting member 36 so that the length L1 of the bristles becomes 6.5 mm.

According to the present exemplary embodiment, the amount of inroad of the conductive brush 31 into the intermediate transfer belt 20 (also simply referred to as "the inroad amount of the conductive brush 31") is set to 0.9 mm which is smaller than the inroad amount of the paper dust collection brush 33. Similar to the case of the paper dust collection brush 33, the inroad amount of the conductive brush 31 is defined by subtracting from the pile length in a single state of the conductive brush 31 the distance between the pile base and the intermediate transfer belt 20 in a state where the conductive brush 31 is fixed to the supporting member 36. The inroad amount of the conductive brush 31 is made smaller than the inroad amount of the paper dust collection brush 33 so that paper dust transferred onto the intermediate transfer belt 20 is caught not by the conductive brush 31 but by the paper dust collection brush 33.

When the inroad amount of the conductive brush 31 is larger than the inroad amount of the paper dust collection brush 33, the effect that the conductive brush 31 strips off and catches paper dust on the intermediate transfer belt 20 is larger than the effect that the paper dust collection brush 33 strips off and catches paper dust. In this case, paper dust that has not been collected by the paper dust collection brush 33 is liable to be collected by the conductive brush 31. Therefore, according to the present exemplary embodiment, the inroad amount of the conductive brush 31 is made smaller than the inroad amount of the paper dust collection brush 33 to prevent accumulation of paper dust in the conductive brush 31.

From the viewpoint of the charging performance of the conductive brush 31, it is not desirable to increase the inroad amount of the conductive brush 31. When the conductive brush 31 is applied with the positive cleaning voltage, the electric discharge phenomenon occurs most actively at the bristle tip of the conductive brush 31. Therefore, setting a small inroad amount of the conductive brush 31 leads to a state where the bristle tip of the conductive brush 31 stands relative to the intermediate transfer belt 20. This state is the optimal state for charging residual toner on the intermediate transfer belt 20. On the contrary, setting a large inroad amount of the conductive brush 31 leads to a state where the bristle tip of the conductive brush 31 bends causing the bristle side portion to contact the intermediate transfer belt 20. When the conductive brush 31 is applied with the positive cleaning voltage in this state, the injection current to the intermediate transfer belt 20 becomes more dominant than the electric discharge phenomenon in electric charge transfer between the conductive brush 31 and the intermediate transfer belt 20, possibly degrading the charging performance of the conductive brush 31. Therefore, in a case where the inroad amount of the paper dust collection brush 33 is large enough to ensure sufficient paper dust collection performance, making the inroad amount of the conductive brush 31 larger than the inroad amount of the paper dust collection brush 33 degrades the charging performance of the conductive brush 31, possibly degrading the cleaning performance.

For this reason, according to the present exemplary embodiment, the inroad amounts are set so that the relation "Inroad amount of the paper dust collection brush 33">"Inroad amount of the conductive brush 31" is satisfied. This enables achieving favorable charging performance of the conductive brush 31 while ensuring sufficient paper dust collection performance of the paper dust collection brush 33.

(4) Confirming the Effects

Results of an image output experimental test according to the present exemplary embodiment and the comparative example will be described below. In the description of the comparative example, elements having an identical or corresponding function or configuration to elements of the present exemplary embodiment are assigned the same reference numerals.

The results of the comparison are described between the image forming apparatus 10 according to the present exemplary embodiment and the image forming apparatus 10 according to a first comparative example which is not provided with the paper dust collection brush 33. The image forming apparatus 10 according to the first comparative example has substantially the same configuration as the image forming apparatus 10 according to the present exemplary embodiment except that the paper dust collection brush 33 is not provided.

The image output experimental test (sheet supply durability test) was performed under the following conditions. Text images of the Y (yellow), M (magenta), C (cyan), and K (black) colors having a 1% printing rate (image area ratio) were printed on paper of Office 70 (name of a product from Canon) as the recording material P. Using the normal paper mode as the image forming mode, one-sided continuous printing was performed with a process speed of 180 mm/second and a throughput of 30 prints/minute. Evaluation images were sampled when the image output experimental test was started (number of prints=0) and each time the number of prints reached 20,000. As evaluation images, three solid images (maximum density level images), three halftone images, and three thin line text images were output in each of the C (cyan), M (magenta), Y (yellow), K (black), R (red), B (blue), and G (green) colors. Then, sampled evaluation images were evaluated about whether an image failure resulting from inferior cleaning occurred. More specifically, evaluation was performed by observing whether an image (ghost image) before one round of the intermediate transfer belt 20 occurred in the sampled evaluation images. Evaluation criteria were based on whether a cleaning failure did not occur (no failure) or a cleaning failure occurred (failure).

Evaluation results are illustrated in Table 1. Table 1 illustrates evaluation results (presence or absence of a cleaning failure) about evaluation images sampled for every 20,000 prints according to the present exemplary embodiment and the first comparative example.

TABLE 1

| Number of prints | First comparative example (paper dust collection brush not provided) | Present exemplary embodiment (paper dust collection brush provided) |
|---|---|---|
| 0 | no failure | no failure |
| 20,000 | no failure | no failure |
| 40,000 | no failure | no failure |
| 60,000 | no failure | no failure |
| 80,000 | failure | no failure |
| 100,000 | failure | no failure |
| 120,000 | failure | no failure |
| 140,000 | failure | no failure |

As illustrated in Table 1, according to the first comparative example, a cleaning failure occurred when the number of prints reached 80,000. When the number of prints reached 80,000, accumulation of a large amount of paper dust in the conductive brush 31 was confirmed. The amount of paper dust accumulated was uneven in the direction approximately perpendicular to the moving direction of the intermediate transfer belt 20 (in the width direction of the recording material P), and a remarkably large amount of paper dust was accumulated particularly at the portions corresponding to the positions of the feeding rollers 14. When the feeding rollers 14 feed the recording material P, paper dust is generated by the rubbing between the recording material P and the feeding rollers 14. Therefore, a large amount of paper dust is assumed to be sent particularly to the portions corresponding to the positions of the feeding rollers 14. As a result, the charging performance of the conductive brush 31 became uneven in the longitudinal direction of the conductive brush 31. At the portions corresponding to the positions of the feeding rollers 14, the charging performance was particularly low and a ghost image notably occurred. Subsequently, when the image output experimental test was continued, the amount of paper dust accumulated in the conductive brush 31 further increased, and cleaning failures continued occurring more clearly.

On the other hand, according to the present exemplary embodiment, a cleaning failure did not occur even when the number of prints reached 140,000. When the number of prints reached 140,000, accumulation of paper dust in the conductive brush 31 was not confirmed while accumulation of a large amount of paper dust in the paper dust collection brush 33 was confirmed.

Results of similar image output experimental tests according to second and third comparative examples will be described below. The image output experimental tests according to the second and third comparative examples are different from the image output experimental test according to the present exemplary embodiment in the relation between the inroad amount of the conductive brush 31 and the inroad amount of the paper dust collection brush 33. The image forming apparatus 10 according to the second and the third comparative examples has a substantially similar configuration to the image forming apparatus 10 according to the present exemplary embodiment except for the relation between the inroad amount of the conductive brush 31 and the inroad amount of the paper dust collection brush 33.

According to the second comparative example, the inroad amount of the paper dust collection brush 33 was set to 2.5 mm which is the same as the inroad amount according to the present exemplary embodiment, and the inroad amount of the conductive brush 31 was set to 3.0 mm which is larger than the inroad amount according to the present exemplary embodiment so that the relation "Inroad amount of the paper dust collection brush 33"<"Inroad amount of the conductive brush 31" was satisfied.

According to the third exemplary embodiment, the inroad amount of the conductive brush 31 was set to 0.9 mm which is the same as the inroad amount according to the present exemplary embodiment, and the inroad amount of the paper dust collection brush 33 was set to 0.5 mm which is smaller than the inroad amount according to the present exemplary embodiment so that the relation "Inroad amount of the paper dust collection brush 33"<"Inroad amount of the conductive brush 31" was satisfied.

The image output experimental test method and the evaluation method are similar to the above-described ones. Evaluation results are illustrated in Table 2. Table 2 illustrates evaluation results (presence or absence of a cleaning failure) of evaluation images sampled for every 20,000 prints according to the present exemplary embodiment and the second and the third comparative examples.

TABLE 2

| | Second comparative example | Third comparative example | Present exemplary embodiment |
|---|---|---|---|
| Inroad amount of conductive brush | 3.0 mm | 0.9 mm | 0.9 mm |
| Inroad amount of paper dust collection brush | 2.5 mm | 0.5 mm | 2.5 mm |
| Number of prints | | | |
| 0 | failure | no failure | no failure |
| 20,000 | failure | no failure | no failure |
| 40,000 | failure | no failure | no failure |
| 60,000 | failure | no failure | no failure |
| 80,000 | failure | no failure | no failure |
| 100,000 | failure | failure | no failure |
| 120,000 | failure | failure | no failure |
| 140,000 | failure | failure | no failure |

As illustrated in Table 2, according to the second comparative example, a cleaning failure already occurred in evaluation images when the image output experimental test was started. More specifically, when solid images were printed as evaluation images as described above, a ghost image before one round of the intermediate transfer belt 20 occurred. According to the second comparative example, the inroad amount of the conductive brush 31 is large, leading to a state where the bristle side portion of the conductive brush 31 contacts the intermediate transfer belt 20, causing the conductive brush 31 to bend. If there is a large amount of residual toner as in a solid image, part of residual toner cannot be suitably positively charged, and a ghost image is assumed to occur after one round of the intermediate transfer belt 20.

According to the third exemplary embodiment, a cleaning failure occurred when the number of prints reached 100,000. When the number of prints reached 100,000, accumulation of a small amount of paper dust in the paper dust collection brush 33 was confirmed while accumulation of a large amount of paper dust in the conductive brush 31 was confirmed. Subsequently, when the image output experimental test was continued, the amount of paper dust accumulated in the conductive brush 31 further increased, and cleaning failures continued occurring more clearly. According to the third exemplary embodiment, the inroad amount of the paper dust collection brush 33 is small, and therefore most of paper dust transferred onto the intermediate transfer belt 20 passes through the paper dust collection brush 33. Then, the paper dust is accumulated in the conductive brush 31 having a larger amount of inroad into the intermediate transfer belt 20 than the inroad amount of the paper dust collection brush 33. The paper dust is assumed to cause a degradation of the charging performance of the conductive brush 31, resulting in a cleaning failure.

According to the present exemplary embodiment, a cleaning failure did not occur when the number of prints reached 140,000, as described above.

As described above, the image forming apparatus 10 according to the present exemplary embodiment is provided with the first brush 31 which contacts the intermediate transfer member 20 to charge toner on the intermediate transfer member 20. The image forming apparatus 10 is further provided with the second brush 33 which contacts the intermediate transfer member 20 at a position on the downstream side of the secondary transfer portion N2 and on the upstream side of the contact portion C between the first brush 31 and the intermediate transfer member 20 in the moving direction of the intermediate transfer member 20. The amount of inroad of the second brush 33 into the intermediate transfer member 20 is larger than the amount of inroad of the first brush 31 into the intermediate transfer member 20. According to the present exemplary embodiment, when the first brush 31 is applied with a voltage having the polarity opposite to the normal charging polarity of toner, toner on the intermediate transfer member 20 is charged to the polarity opposite to the normal charging polarity of toner. At the primary transfer portion N1, toner on the intermediate transfer member 20 charged by the first brush 31 is transferred from the intermediate transfer member 20 to the image bearing member 2 and then collected.

As described above, paper dust can be prevented from being accumulated in the conductive brush 31 by collecting paper dust on the intermediate transfer belt 20 by using the paper dust collection brush 33 provided on the upstream side of the conductive brush 31. This enables suitably charging residual toner by using the conductive brush 31 over a longer period of time, compared to a case where the paper dust collection brush 33 is not provided. Favorable paper dust collection performance of the paper dust collection brush 33 can be maintained for a prolonged period of time while ensuring the suitable charging performance of the conductive brush 31 by making the inroad amount of the paper dust collection brush 33 larger than the inroad amount of the conductive brush 31. More specifically, according to the present exemplary embodiment, the paper dust collection brush 33 is provided on the upstream side of the conductive brush 31, and the inroad amount of the paper dust collection brush 33 is made larger than the inroad amount of the conductive brush 31. This enables preventing paper dust from being accumulated in the conductive brush 31 and maintaining the charging performance of the conductive brush 31 for a prolonged period of time, and the life of the cleaning performance can be extended.

(5) Modifications

Figure 4:
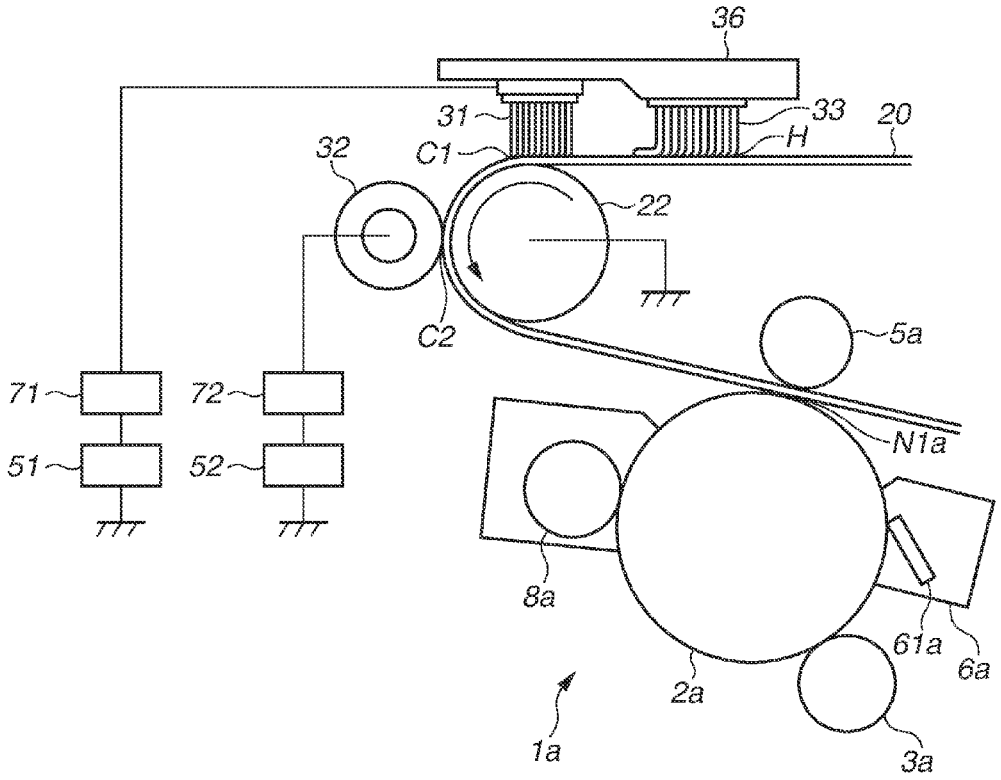
FIG. 4 is a sectional view schematically illustrating another example of a belt cleaning device.

Although, in the present exemplary embodiment, only the conductive brush 31 is provided as a charging member, a plurality of charging members may be provided to obtain higher charging performance. For example, as illustrated in FIG. 4, the belt cleaning device 30 may include a charging roller 32 as a second charging member (charging device), a second current detection circuit 72, and a second toner charging power source (high-voltage power source circuit) 52 in addition to the above-described configuration. The charging roller 32 is disposed to come into contact with the intermediate transfer belt 20 on the downstream side of a first toner charging portion C1 (equivalent to the toner charging portion C illustrated in FIG. 2) and on the upstream side of the primary transfer portion N1 (the primary transfer portion N1Y on the most upstream side) in the moving direction of the intermediate transfer belt 20. The contact portion between the charging roller 32 and the intermediate transfer belt 20 is a second toner charging portion C2 where residual toner on the intermediate transfer belt 20 is charged. The charging roller 32 may be composed of a nickel-plated steel rod coated with a solid elastic member made of EPDM rubber containing distributed carbon. The charging roller 32 rotates while being driven by the intermediate transfer belt 20. In the cleaning operation, the charging roller 32 is applied with a positive cleaning voltage (cleaning bias) from the second toner charging power source 52 so that a constant current value is detected by the second current detection circuit 72. Thus, toner on the intermediate transfer belt 20 can be charged to the polarity opposite to the normal charging polarity of toner by the charging roller 32. This enables further improving the residual toner charging performance of the belt cleaning device 30.

Figure 5A:
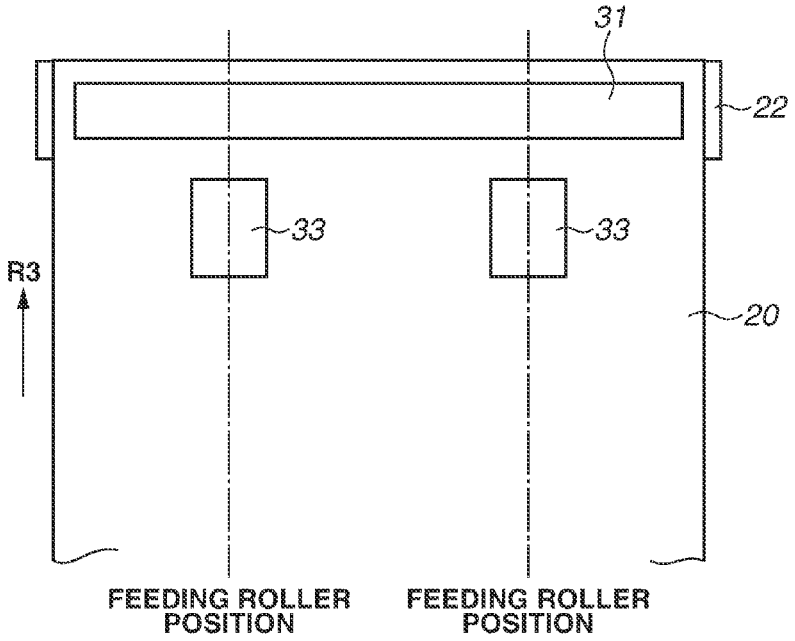
FIGS. 5A and 5B are schematic views illustrating other examples of belt cleaning devices.
Figure 5B:
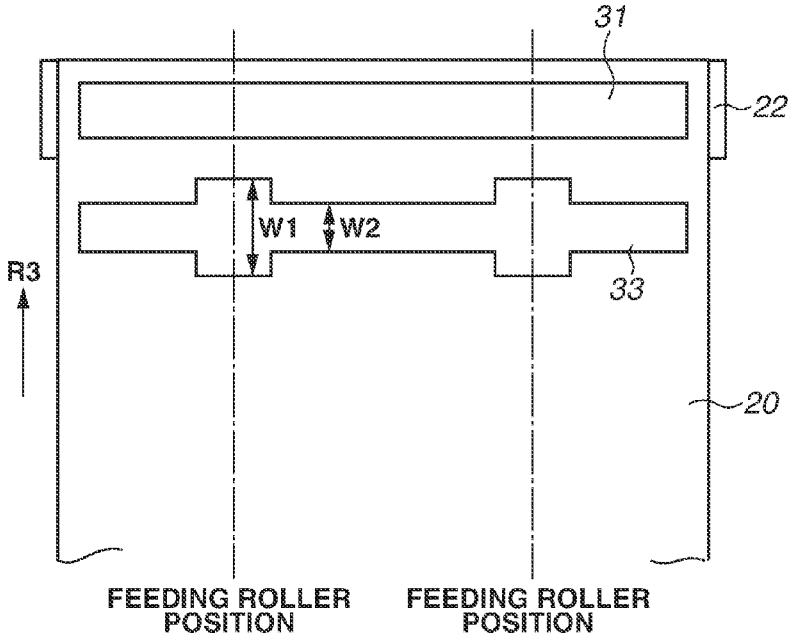

The configuration of the paper dust collection brush 33 can be optimized according to the amount of paper dust sent to the belt cleaning device 30. For example, as illustrated in FIG. 5A, the paper dust collection brush 33 can be disposed at a portion where a large amount of paper dust is sent to the cleaning device 30 in the width direction of the recording material P, i.e., only in a predetermined range including the portions corresponding to the positions of the feeding rollers 14 according to the present exemplary embodiment. For example, as illustrated in FIG. 5B, a width W1 (width in the moving direction of the intermediate transfer belt 20) of the paper dust collection brush 33 at the portions corresponding to the positions of the feeding rollers 14 can be made larger than the width W2 of the paper dust collection brush 33 at the other portions. More specifically, the paper dust collection brush 33 may have a plurality of portions having different widths in the moving direction of the intermediate transfer belt 20, disposed in the direction approximately perpendicular to the moving direction of the intermediate transfer belt 20. Examples of a position where the paper dust collection brush 33 is selectively disposed and a position where the width of the paper dust collection brush 33 is selectively increased include not only the positions corresponding to the feeding rollers 14 but also the positions corresponding to the ends (edge portions) in the direction approximately perpendicular to the conveyance direction of the recording material P. A configuration efficient in cost and space can be achieved by optimizing the configuration of the paper dust collection brush 33 according to the amount of paper dust sent to the belt cleaning device 30 in this way.

The number of the paper dust collection brushes 33 does not need to be one. A plurality of paper dust collection brushes 33 may be disposed in the moving direction of the intermediate transfer belt 20 in consideration of the balance between the amount of paper dust sent to the belt cleaning device 30 and the product life.

Figure 6A:
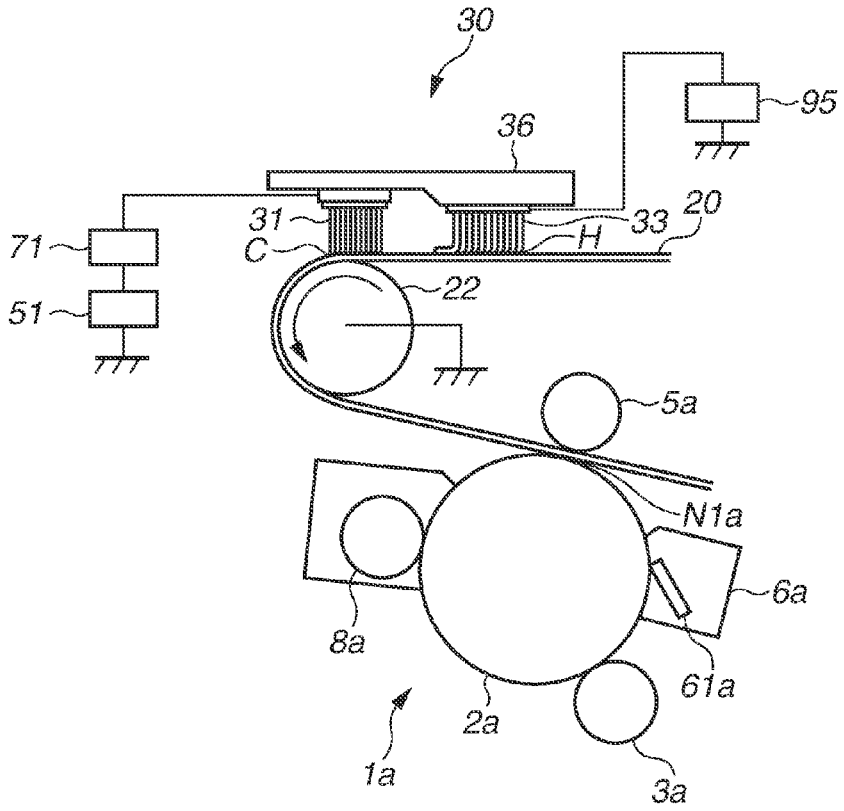
FIGS. 6A and 6B are sectional views schematically illustrating other examples of belt cleaning devices.

As illustrated in FIG. 6A, paper dust in the paper dust collection brush 33 may be electrostatically collected by applying a collection voltage (collection bias) from a collection power source (high-voltage power source circuit) 95 to the paper dust collection brush 33. For example, paper dust generated by the rubbing between the recording material P and the feeding rollers 14 may be charged to either the positive or the negative polarity according to the triboelectric series of the recording material P and the feeding rollers 14. If paper dust has a tendency to be positively charged, applying a negative collection voltage to the paper dust collection brush 33 enables collecting paper dust not only mechanically but also electrostatically, thus improving the paper dust collection performance. For example, for each product configuration, the paper dust collection performance can be improved by checking the charging polarity of paper dust liable to be transferred onto the intermediate transfer belt 20 and applying the collection voltage having the polarity opposite to the charging polarity of paper dust to the paper dust collection brush 33. However, residual toner also exists on the intermediate transfer belt 20. Therefore, to prevent residual toner from being electrostatically collected by the paper dust collection brush 33, it is desirable to apply the collection voltage to the paper dust collection brush 33 only at a timing (at a timing of not forming an image such as sheet interval and post-rotation) when residual toner does not exist on the intermediate transfer belt 20. In other words, it is desirable that the paper dust collection brush 33 is applied with the collection voltage while a region other than regions on the intermediate belt 20 where toner that is left during secondary transfer exists is passing through the paper dust collection portion H in the moving direction of the intermediate transfer belt 20. Alternatively, it is also possible to apply the collection voltage to the paper dust collection brush 33 at a timing when residual toner exists or does not exist on the intermediate transfer belt 20, and periodically perform a process for mechanically and electrostatically discharging toner accumulated in the paper dust collection brush 33. The toner discharge operation can be performed in a similar way to the above-described one for the conductive brush 31.

Figure 6B:
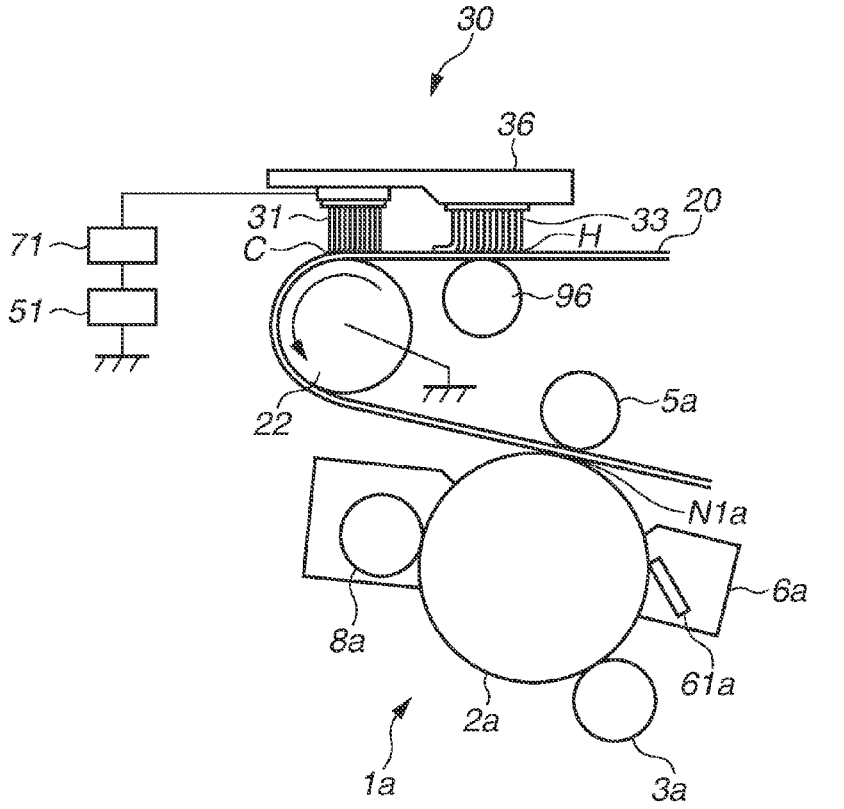

As described above, the paper dust collection performance of the paper dust collection brush 33 is largely affected by the inroad amount of the paper dust collection brush 33. As illustrated in FIG. 6B, to stabilize the inroad amount of the paper dust collection brush 33, a backup member 96 in contact with the paper dust collection brush 33 via the intermediate transfer belt 20 may be disposed on the back side (inner circumference side) of the intermediate transfer belt 20. For example, providing a rotating roller, skid, or supporting pad as the backup member 96 enables preventing variations in the inroad amount of the paper dust collection brush 33 caused by the flopping of the intermediate transfer belt 20, ensuring more stable paper dust collection performance. When the paper dust collection brush 33 is applied with the voltage as described above, the backup member 96 can be electrically grounded. The paper dust collection brush 33 and the conductive brush 31 may contact a common backup member such as a stretching roller via the intermediate transfer belt 20.

A second exemplary embodiment of the present disclosure will be described below. The basic configuration and operation of the image forming apparatus 10 according to the present exemplary embodiment are similar to the basic configuration and operation according to the first exemplary embodiment. In the description of the image forming apparatus 10 according to the present exemplary embodiment, elements having an identical or corresponding function or configuration to the function or configuration of the image forming apparatus 10 according to the first exemplary embodiment are assigned the same reference numerals, and detailed description thereof will be omitted.

According to the present exemplary embodiment, residual toner charged by the conductive brush 31 is not transferred onto the photosensitive member 2 but collected by a collection member disposed on the downstream side of the conductive brush 31.

Figure 7:
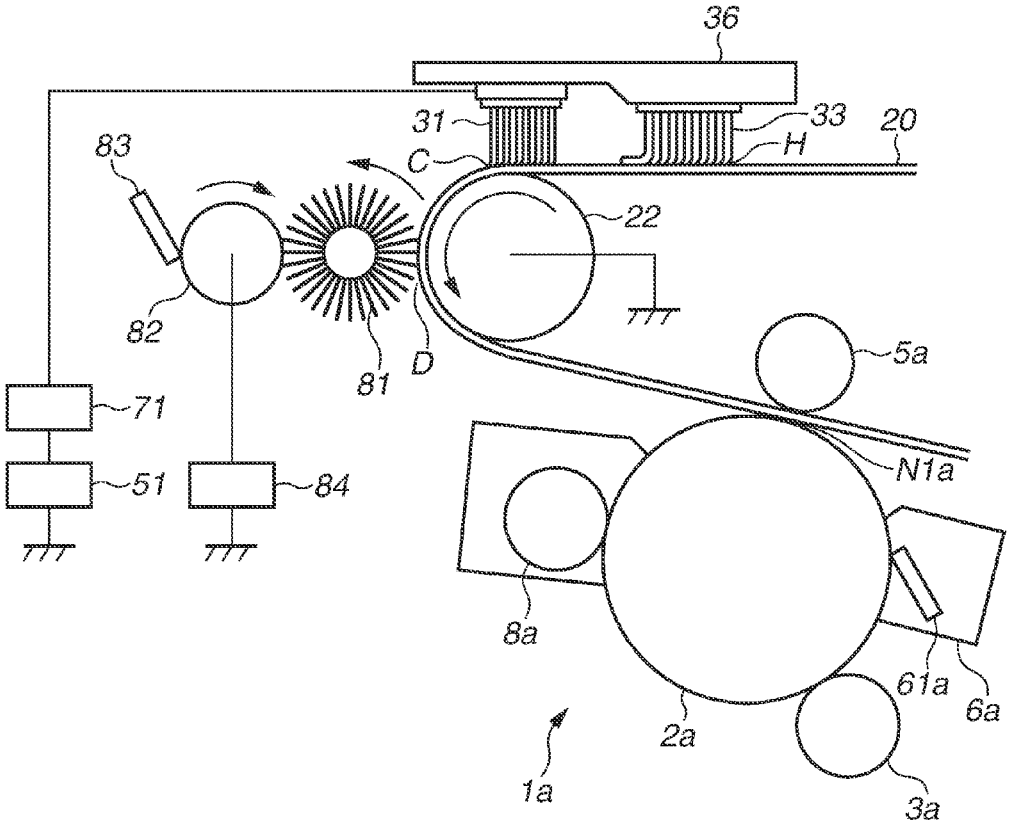
FIG. 7 is a sectional view schematically illustrating yet another example of a belt cleaning device.

According to the present exemplary embodiment, as illustrated in FIG. 7, the belt cleaning device 30 includes a collection member (including a fur brush 81, a cleaning roller 82, and a cleaning blade 83) and a collection power source (high-voltage power source circuit) 84 as a second power source in addition to the configuration of the first exemplary embodiment.

The fur brush 81 is disposed to come into contact with the intermediate transfer belt 20 on the downstream side of the toner charging portion C and on the upstream side of the primary transfer portion N1 (the primary transfer portion N1Y on the most upstream side) in the moving direction of the intermediate transfer belt 20. The contact portion between the fur brush 81 and the intermediate transfer belt 20 is a collection portion D where residual toner on the intermediate transfer belt 20 is collected. The fur brush 81 is rotatably driven by a driving device (not illustrated) to move in the direction opposite to the rotational direction of the intermediate transfer belt 20 at the contact portion in contact with the intermediate transfer belt 20. According to the present exemplary embodiment, nylon provided with electroconductivity is used as the material of the brush fibers of the fur brush 81. The brush fibers have a fineness of 7 decitex, a pile length of 6 mm, and a density of 100 KF(s)/inch$^2$. The amount of inroad of the fur brush 81 into the intermediate transfer belt 20 was set to 1.0 mm. The fur brush 81 has an electrical resistance of $1.0\times10^7$ ohms (Ω) when applied with 500 V in a state where the fur brush 81 is pressed onto an aluminum cylinder with a force of 9.8 N and rotated at a rotational speed of 50 mm/second.

The cleaning roller 82 is disposed in contact with the fur brush 81. The cleaning roller 82 is rotatably driven by a driving device (not illustrated) to move in the same direction as the fur brush 81 at the contact portion in contact with the fur brush 81. According to the present exemplary embodiment, a metal roller made of steel use stainless (SUS) is used as the cleaning roller 82. In the cleaning operation, the cleaning roller 82 is applied with a negative collection voltage (collection bias) from the collection power source 84. As a result, the fur brush 81 is also applied with the negative collection voltage via the cleaning roller 82.

The cleaning blade 83 is a plate-shaped member formed of an elastic body such as urethane rubber and is disposed in contact with the cleaning roller 82.

In the cleaning operation, the fur brush 81 applied with the negative collection voltage electrostatically and mechanically scratches residual toner, positively charged by the conductive brush 31, from the intermediate transfer belt 20 to clean the intermediate transfer belt 20. The positively charged residual toner scratched by the fur brush 81 is transferred onto the cleaning roller 82 applied with the negative collection voltage. Then, the residual toner transferred onto the cleaning roller 82 is removed from the surface of the cleaning roller 82 by the cleaning blade 83 and then stored into a collection container (not illustrated).

In a case of collecting residual toner on the intermediate transfer belt 20 onto the photosensitive member 2 simultaneously with the primary transfer of the toner image from the photosensitive member 2 onto the intermediate transfer belt 20 as in the first exemplary embodiment, the cleaning performance may possibly change depending on a primary transfer condition. The primary transfer condition includes the magnitude of the primary transfer voltage and the state of the photosensitive member 2. According to the present exemplary embodiment, residual toner on the intermediate transfer belt 20 is collected by a collection member, and stable cleaning performance can be ensured regardless of the primary transfer condition.

Also according to the present exemplary embodiment, similar to the first exemplary embodiment, the paper dust collection brush 33 is disposed on the upstream side of the conductive brush 31, and the inroad amount of the paper dust collection brush 33 is made larger than the inroad amount of the conductive brush 31. These inroad amounts according to the present exemplary embodiment are the same as the inroad amounts according to the first exemplary embodiment. This enables obtaining similar effects to the effects according to the first exemplary embodiment. Further, according to the present exemplary embodiment, disposing the paper dust collection brush 33 also enables obtaining an effect that the collection performance of the fur brush 81 can be maintained for a prolonged period of time. More specifically, if a large number of sheets are printed in a case where the paper dust collection brush 33 is not provided, part of paper dust transferred onto the intermediate transfer belt 20 is gradually caught in gaps in the pile of the fur brush 81 with increasing number of prints. Eventually, clogging of the fur brush 81 may occur. If the fur brush 81 gets clogged by paper dust, the toner collection performance of the fur brush 81 degrades, possibly leading to a cleaning failure.

According to the present exemplary embodiment, the image forming apparatus 10 includes a collection member 81 for collecting toner on the intermediate transfer member 20 on the downstream side of the contact portion C between the first brush 31 and the intermediate transfer member 20 and on the upstream side of the primary transfer portion N1 in the moving direction of the intermediate transfer member 20. The first brush 31 is applied with a voltage having a predetermined polarity (positive polarity in the present exemplary embodiment) to charge toner on the intermediate transfer member 20 to the predetermined polarity. Then, the collection member 81 is applied with a voltage having the polarity opposite to the predetermined polarity (having the negative polarity in the present exemplary embodiment) and collects the toner on the intermediate transfer member 20 charged to a predetermined polarity by the first brush 31.

As described above, according to the present exemplary embodiment, effects similar to the effects according to the first exemplary embodiment can be obtained and the fur brush 81 can be prevented from getting clogged with paper dust in a configuration using the fur brush 81 as a collection member. Therefore, according to the present exemplary embodiment, the charging performance of the conductive brush 31 and the toner collection performance of the fur brush 81 can be maintained for a prolonged period of time, and the life of the cleaning performance can be extended.

Although, in the present exemplary embodiment, the fur brush 81 is used as a collection member, the collection member is not limited thereto. For example, instead of using the fur brush 81, the cleaning roller 82 applied with the negative collection voltage may be brought into direct contact with the intermediate transfer belt 20. In this case, the residual toner positively charged by the conductive brush 31 is directly collected by the cleaning roller 82.

Figure 8:
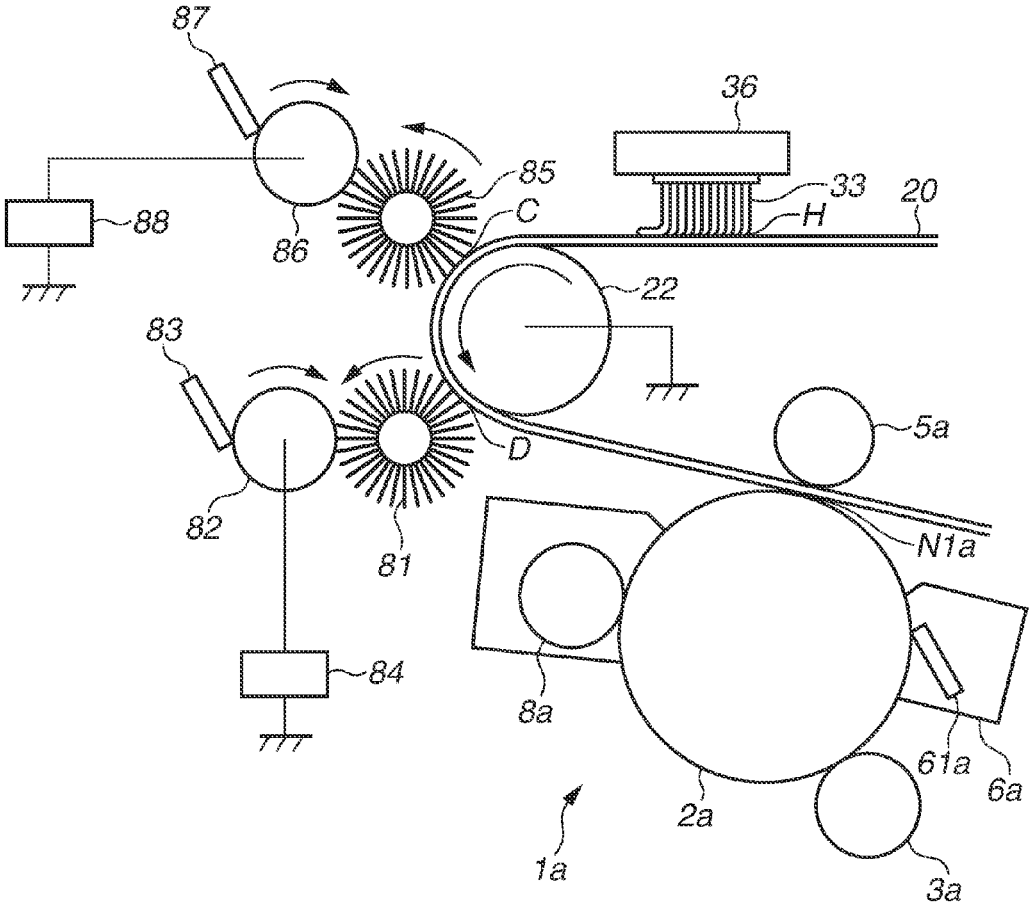
FIG. 8 is a sectional view schematically illustrating yet another example of a belt cleaning device.

The belt cleaning device 30 may be configured as illustrated in FIG. 8. More specifically, instead of the conductive brush 31, the belt cleaning device 30 illustrated in FIG. 8 includes another collection member including an upstream fur brush 85, an upstream cleaning roller 86, and an upstream cleaning blade 87. The belt cleaning device 30 includes an upstream collection power source 88. For example, the amount of inroad of the upstream fur brush 85 into the intermediate transfer belt 20 is set to 1.0 mm, and the inroad amount of the paper dust collection brush 33 is set to 2.5 mm which is the same as the inroad amount according to the first exemplary embodiment.

The configurations and operations of the upstream fur brush 85, the upstream cleaning roller 86, the upstream cleaning blade 87, and the upstream collection power source 88 are approximately similar to the configurations and operations of the fur brush 81, the cleaning roller 82, the cleaning blade 83, and the collection power source 84 described above. However, in the cleaning operation, the upstream cleaning roller 86 is applied with a positive collection voltage from the upstream collection power source 88. Thus, the upstream fur brush 85 is also applied with the positive collection voltage via the upstream cleaning roller 86. Negatively charged toner out of residual toner on the intermediate transfer belt 20 is electrostatically and mechanically collected from the intermediate transfer belt 20 by the upstream fur brush 85 applied with the positive collection voltage. At the same time, the upstream fur brush 85 applied with the positive collection voltage uniformly charges residual toner passing through the upstream fur brush 85 to the positive polarity. Thus, in the cleaning device 30 illustrated in FIG. 8, the upstream fur brush 85 is provided with both the function of a charging member and the function of a collection member, and the upstream collection power source 88 is also provided with the function of a toner charging power source. The negatively charged residual toner collected from the intermediate transfer belt 20 by the upstream fur brush 85 is transferred onto the upstream cleaning roller 86 and then stored into a collection container (not illustrated) by the upstream cleaning blade 87. The residual toner positively charged by the upstream fur brush 85 is collected by the fur brush 81 on the downstream side, in a similar way to the case of the cleaning device 30 illustrated in FIG. 7. In this way, residual toner on the intermediate transfer belt 20 can be cleaned by using two different fur brushes applied with voltages having different polarities.

Also in the configuration having two different fur brushes (brushes rotatable while in contact with the intermediate transfer member 20) as illustrated in FIG. 8, providing the paper dust collection brush 33 on the upstream side of the fur brushes enables preventing the fur brushes from getting clogged with paper dust caught in gaps of the fur brushes. When the inroad amount of the paper dust collection brush 33 is made larger than the inroad amount of the upstream fur brush 85, paper dust transferred onto the intermediate transfer belt 20 is unlikely to be caught in gaps of the upstream fur brush 85. In addition, the suitable toner charging performance of the upstream fur brush 85 can be maintained for a prolonged period of time.

In a case of providing a collection member on the downstream side of the first brush as a charging member (including a case where the charging member also serves as a collection member), the first brush and the collection member need to be applied with voltages having opposite polarities. Although, in each of the above-described examples, the first brush is applied with a positive voltage and the collection member is applied with a negative voltage, the first brush may be applied with a negative voltage and the collection member may be applied with a positive voltage.

A third exemplary embodiment according to the present disclosure will be described below. Although, in the first and the second exemplary embodiments, the present disclosure is applied to the intermediate transfer member cleaning unit, the present disclosure is also applicable to cleaning units of other rotating bodies (conveyance members). The present exemplary embodiment will be described below centering on a case where the present invention is applied to a cleaning unit of a conveyance belt in a direct-transfer-type image forming apparatus having a conveyance belt as a recording material bearing member.

Figure 9:
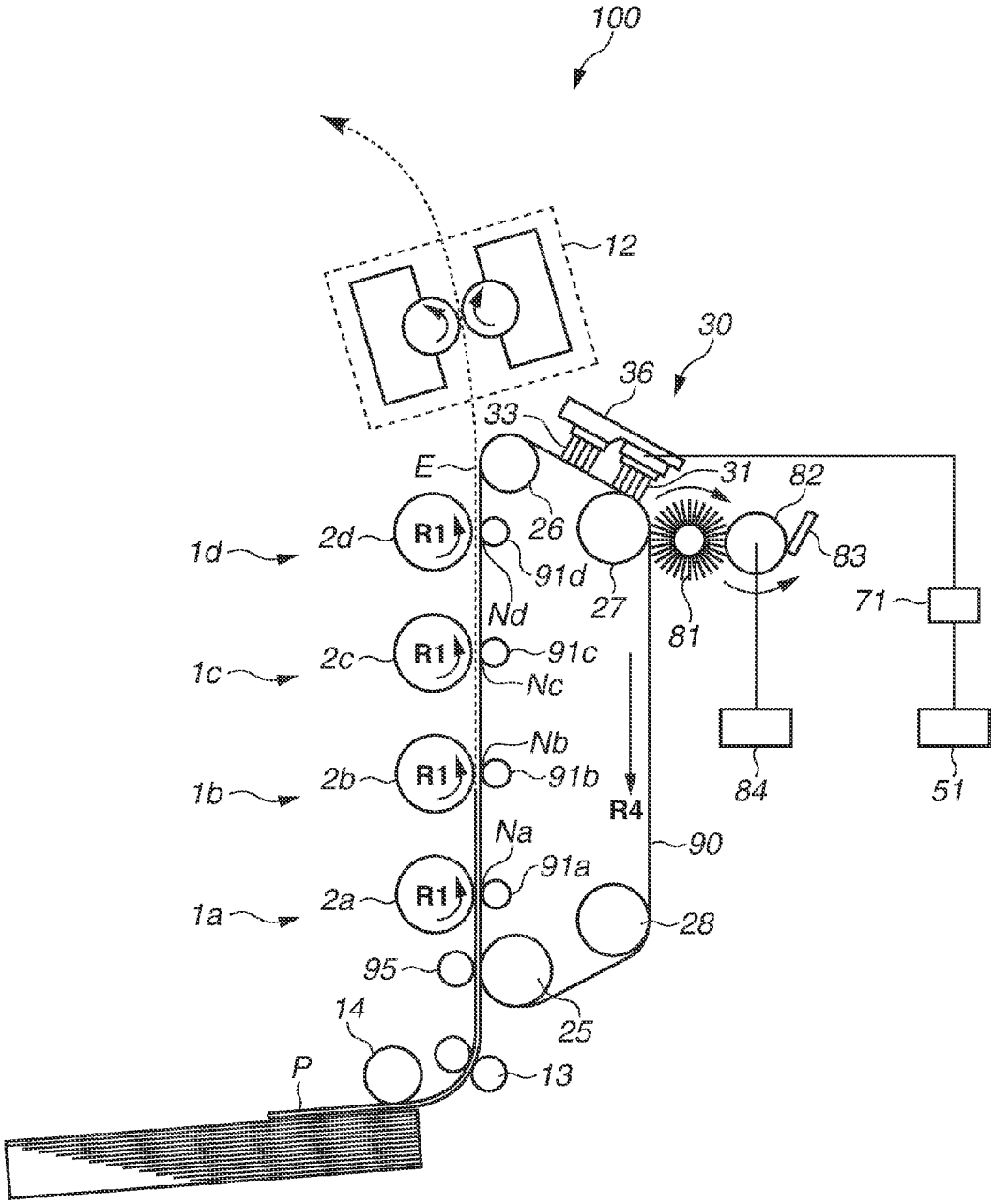
FIG. 9 is a sectional view schematically illustrating essential parts of another example of an image forming apparatus.

FIG. 9 is a sectional view schematically illustrating parts of an image forming apparatus 100 according to the present exemplary embodiment. In the description of the image forming apparatus 100 according to the present exemplary embodiment, elements having an identical or corresponding function or configuration to the function or configuration of the image forming apparatus 10 according to the first and the second exemplary embodiments are assigned the same reference numerals, and detailed description thereof will be omitted. Referring to FIG. 9, elements of the image forming units 1*a* to 1*d* will be suitably omitted.

The image forming apparatus 100 according to the present exemplary embodiment includes a conveyance belt 90 as an endless belt instead of the intermediate transfer belt 20 according to the first and the second exemplary embodiments. The conveyance belt 90 is an example of a recording material bearing belt that can circularly move to bear and convey a recording material onto which a toner image is to be transferred from the image bearing member 2 at the transfer portion. According to the present exemplary embodiment, an endless belt made of PVDF having a volume resistivity of $5.0\times10^{11}$ ohm-centimeters (Ωcm) is used as the conveyance belt 90. In addition, an endless belt made of a resin such as ETFE, polyimide, PET, and polycarbonate can be used as the conveyance belt 90. Alternatively, the conveyance belt 90 may also be composed of a rubber base such as EPDM rubber coated with urethane rubber containing a distributed fluoride resin such as PTFE in the shape of an endless belt. The conveyance belt 90 supported by four shafts of stretching rollers 25, 26, 27, and 28, electrostatically absorbs the recording material P on the outer circumferential surface, and circularly moves (rotates)

in the direction of the arrow R4 (clockwise direction) to bring the recording material P into contact with each photosensitive member 2.

A transfer roller 91 as a transfer unit corresponding to the photosensitive member 2 is disposed on the inner circumference surface of the conveyance belt 90. The transfer roller 91 is pressed onto the photosensitive member 2 via the conveyance belt 90 to form a transfer portion N as a contact portion between the photosensitive member 2 and the conveyance belt 90. In the transfer process, the transfer roller 91 is applied with a transfer voltage (transfer bias) having the polarity opposite to the normal charging polarity of toner (having the positive polarity in the present exemplary embodiment) from a transfer power source (high-voltage power source circuit, not illustrated). Thus, a toner image on each photosensitive member 2 is electrostatically transferred onto the recording material P on the conveyance belt 90. At a separation portion E as a position of the conveyance belt 90 wound around the stretching roller 26, the recording material P with a toner image transferred thereon is separated from the conveyance belt 90 by the curvature of the stretching roller 26 and then conveyed to the fixing device 12.

The recording material P is pinched between an electrostatic adsorption roller 92 and the conveyance belt 90 so as to be pressed onto the outer circumferential surface of the conveyance belt 90. When a voltage is applied between the conveyance belt 90 and the electrostatic adsorption roller 92, electric charges are induced on paper (dielectric body) as the recording material P and the dielectric layer of the conveyance belt 90. The recording material P is electrostatically stuck to the outer circumferential surface of the conveyance belt 90. Thus, while being stably stuck to the conveyance belt 90, the recording material P is conveyed to the transfer portion N on the most downstream side.

In the image forming apparatus 100 according to the present exemplary embodiment, a toner image is directly transferred onto the recording material P on the conveyance belt 90, and therefore toner transferred onto the recording material P and fogging toner on the photosensitive member 2 may adhere to the conveyance belt 90 as a recording material bearing member. The toner adhering to the recording material bearing member is transferred onto a newly conveyed recording material P, possibly soiling the recording material P. To prevent spoiling the recording material P, according to the present exemplary embodiment, the belt cleaning device 30 for removing toner adhering to the conveyance belt 90 is provided.

In this case, not only toner but also paper dust dropped from paper frequently used as the recording material P conveyed by the conveyance belt 90 adheres onto the conveyance belt 90. If the paper dust is accumulated in the conductive brush 31 and forms a paper dust accumulation substance, a cleaning failure on the conveyance belt 90 may occur similar to the case of the intermediate transfer member cleaning unit.

To prevent this problem, the present exemplary embodiment employs a cleaning device 30 similar to the one according to the second exemplary embodiment as a belt cleaning device 30. Also according to the present exemplary embodiment, similar to the above-described exemplary embodiments, the paper dust collection brush 33 is disposed on the upstream side of the conductive brush 31, and the amount of inroad of the paper dust collection brush 33 into the conveyance belt 90 is made larger than the amount of inroad of the conductive brush 31 into the conveyance belt 90. Residual toner on the conveyance belt 90 charged by the electric conduction brush 31 is collected by the fur brush 81. This enables obtaining effects similar to the effects according to the first and the second exemplary embodiments, also for the cleaning of the conveyance belt 90.

Also in the direct-transfer-type image forming apparatus 100, toner on the conveyance belt 90 can be cleaned by a collection member employing two different fur brushes applied with voltages having different polarities as described in the second exemplary embodiment with reference to FIG. 8. The direct-transfer-type image forming apparatus 100 may also be provided with other features of the above-described cleaning device 30 related to the intermediate-transfer-type image forming apparatus 10, such as the one described with reference to FIGS. 5A, 5B, 6A, and 6B. Similar to the case of the intermediate-transfer-type image forming apparatus 10, it is desirable to apply a voltage to the paper dust collection brush 33, as illustrated in FIG. 5A, in the following way. To prevent toner adhering to the conveyance belt 90 from being electrostatically collected by the paper dust collection brush 33, it is desirable to apply a collection voltage to the paper dust collection brush 33 only at a timing (at a timing of not forming an image such as sheet interval and post-rotation) when the toner does not exist on the conveyance belt 90. In other words, it is desirable that the paper dust collection brush 33 is applied with a voltage when a region other than regions on the intermediate belt 20 where toner has adhered during transfer is passing through the paper dust collection portion H in the moving direction of the conveyance belt 90. Alternatively, similar to the case of the intermediate-transfer-type image forming apparatus 10, a process of discharging toner from the paper dust collection brush 33 may be performed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2016-140775, filed Jul. 15, 2016, which is hereby incorporated by reference herein in its entirety.

What is claimed is:

1. An image forming apparatus comprising:

an image bearing member configured to bear a toner image;

a transfer belt configured to transfer the toner image from the image bearing member to a recording material;

a first brush configured to charge toner on the transfer belt; and a second brush configured to contact the transfer belt at a position on an upstream side of a contact portion between the first brush and the transfer belt in a moving direction of the transfer belt, and collect material dust moved from the recording material to the transfer belt, wherein an amount of inroad of the second brush into the transfer belt is larger than the amount of inroad of the first brush into the transfer belt.

2. The image forming apparatus according to claim 1, further comprising a first power source configured to apply a voltage having a polarity opposite to a normal charging polarity of toner to the first brush, wherein the toner on the transfer belt charged by the first brush is transferred from the transfer belt onto the image bearing member and then collected.

3. The image forming apparatus according to claim 2, further comprising a charging device disposed on a downstream side of the contact portion, and configured to charge the toner on the transfer belt to the polarity opposite to the normal charging polarity of toner.

4. The image forming apparatus according to claim 3, wherein the charging device includes a roller to be in contact with the transfer belt.

5. The image forming apparatus according to claim 1, further comprising:

a collection member configured to collect the toner on the transfer belt at a position on a downstream side of the contact portion;

a first power source configured to apply a voltage having a predetermined polarity to the first brush; and a second power source configured to apply a voltage having a polarity opposite to the predetermined polarity to the collection member.

6. The image forming apparatus according to claim 5, wherein the collection member includes a brush rotatable in contact with the transfer belt.

7. The image forming apparatus according to claim 6, wherein the first brush is provided with a brush rotatable in contact with the transfer belt.

8. The image forming apparatus according to claim 1, wherein the second brush has a plurality of portions having different widths in the moving direction of the transfer belt, disposed in a direction approximately perpendicular to the moving direction of the transfer belt.

9. The image forming apparatus according to claim 1, further comprising a pressing member configured to press the second brush via the transfer belt.

10. The image forming apparatus according to claim 1, wherein the second brush is electrically grounded.

11. The image forming apparatus according to claim 1, wherein the second brush is applied with a voltage.

12. The image forming apparatus according to claim 11, wherein the second brush is applied with a voltage while a region other than regions on the transfer belt where toner exists is passing through a contact portion in contact with the second brush in the moving direction of the transfer belt.

13. The image forming apparatus according to claim 1, wherein the transfer belt is an intermediate transfer belt onto which the toner image is primarily transferred from the image bearing member.

14. The image forming apparatus according to claim 1, wherein the transfer belt is a recording material bearing belt onto which the toner image is transferred from the image bearing member.

15. The image forming apparatus according to claim 1, further comprising:

a supporting member that supports the first brush and the second brush to be disposed at a fixed position relative to the transfer belt.

16. The image forming apparatus according to claim 15, wherein the first brush is supported by the supporting member in a state where a bristle tip of the first brush stands relative to the transfer belt.

17. The image forming apparatus according to claim 16, wherein the second brush is supported by the supporting member in a state where a bristle tip of the second brush bends causing a bristle side portion to contact the transfer belt.

18. The image forming apparatus according to claim 1, further comprising:

a first power source capable of applying a voltage having a first polarity and a voltage having a second polarity selectively to the first brush, the first polarity being the same in polarity as normal charging polarity of toner, the second polarity being opposite to the first polarity, wherein the toner passing through the contact portion is charged to the second polarity by applying the voltage having the second polarity to the first brush, and the toner accumulated in the first brush is electrostatically discharged onto the transfer belt from the first brush at the contact portion by applying the voltage having the first polarity to the first brush.

19. The image forming apparatus according to claim 1, wherein, at a contact portion between the second brush and the transfer belt, the second brush allows the toner on the transfer belt to pass while collecting the material dust moved from the recording material to the transfer belt.

* * * * *